US007678718B2

(12) United States Patent
Harris et al.

(10) Patent No.: US 7,678,718 B2
(45) Date of Patent: Mar. 16, 2010

(54) BASE LAYER APPAREL

(75) Inventors: William W. Harris, Pinehurst, NC (US); Tony G. Connor, Eagle Springs, NC (US)

(73) Assignee: Longworth Industries, Inc., West End, NC (US)

( * ) Notice: Subject to any disclaimer, the term of this patent is extended or adjusted under 35 U.S.C. 154(b) by 0 days.

(21) Appl. No.: 11/680,939

(22) Filed: Mar. 1, 2007

(65) Prior Publication Data

US 2008/0214076 A1 Sep. 4, 2008

(51) Int. Cl.

| | |
|---|---|
| ***D04B 1/14*** | (2006.01) |
| ***D04B 1/16*** | (2006.01) |
| ***D04B 1/22*** | (2006.01) |
| ***D04B 1/24*** | (2006.01) |
| ***D02G 3/02*** | (2006.01) |
| ***D02G 3/04*** | (2006.01) |
| ***A41B 1/00*** | (2006.01) |
| ***A41B 9/06*** | (2006.01) |
| ***A41B 9/12*** | (2006.01) |

(52) U.S. Cl. ..... 442/310; 2/456; 2/458; 2/113; 2/400; 57/252; 57/255; 66/171; 442/123; 442/308; 442/318; 428/920; 428/921

(58) Field of Classification Search ..... 442/59, 442/123, 85, 86, 308, 304, 310, 318; 57/252, 57/255; 66/169 R, 170–171, 175–177, 202
See application file for complete search history.

(56) References Cited

U.S. PATENT DOCUMENTS

| | | | | |
|---|---|---|---|---|
| 4,257,221 | A * | 3/1981 | Feinberg | 57/256 |
| 5,888,914 | A | 3/1999 | Katz | |
| 7,174,750 | B2 * | 2/2007 | Shirasaki et al. | 66/195 |
| 2005/0075027 | A1 | 4/2005 | Etchells et al. | |
| 2005/0079783 | A1 * | 4/2005 | Campbell et al. | 442/181 |
| 2005/0130533 | A1 * | 6/2005 | Lapierre | 442/197 |
| 2006/0059634 | A1 | 3/2006 | Tutterow | |
| 2006/0068664 | A1 | 3/2006 | Gibson et al. | |
| 2006/0135014 | A1 | 6/2006 | Murphy et al. | |
| 2008/0057807 | A1 * | 3/2008 | Tutterow et al. | 442/1 |

FOREIGN PATENT DOCUMENTS

| | | | |
|---|---|---|---|
| GB | 2152542 A | * | 8/1985 |
| GB | 2179067 A | * | 2/1987 |

OTHER PUBLICATIONS

Anand, S.C. and S.J. Garvey, "Flame Retardancy". Knitting International, vol. 104, No. 1238, Jun. 1997.*

Ozcan, et al. "Effect of Gray Fabric Properties on Flame Resistance of Knitted Fabric", Textile Research Journal 73(10), 883-891, Otcober 2003.*

* cited by examiner

*Primary Examiner*—Jennifer A Chriss
(74) *Attorney, Agent, or Firm*—Womble Carlyle Sandridge & Rice, PLLC

(57) ABSTRACT

A base layer apparel is provided that is formed from a single or double-knit fabric. The fabric is formed of ring spun fire resistant yarns that are an intimate blend of at least 60 percent modacrylic fibers and up to 40 percent fire-resistant viscose fibers. Anti-microbial and wicking treatments may be applied to the knit fabric.

9 Claims, 3 Drawing Sheets

```
XXXXXXXXXXXXXXXXXXXXXXXXXXXXXXXXXXXX

XXXXXXXXXXXXXXXXXXXXXXXXXXXXXXXXXXXX
   T   T   T   T   T   T   T   T   T
XXXXXXXXXXXXXXXXXXXXXXXXXXXXXXXXXXXX

XXXXXXXXXXXXXXXXXXXXXXXXXXXXXXXXXXXX
 T   T   T   T   T   T   T   T   T
XXXXXXXXXXXXXXXXXXXXXXXXXXXXXXXXXXXX

XXXXXXXXXXXXXXXXXXXXXXXXXXXXXXXXXXXX
   T   T   T   T   T   T   T   T   T
XXXXXXXXXXXXXXXXXXXXXXXXXXXXXXXXXXXX

XXXXXXXXXXXXXXXXXXXXXXXXXXXXXXXXXXXX
 T   T   T   T   T   T   T   T   T
XXXXXXXXXXXXXXXXXXXXXXXXXXXXXXXXXXXX

XXXXXXXXXXXXXXXXXXXXXXXXXXXXXXXXXXXX
   T   T   T   T   T   T   T   T   T
XXXXXXXXXXXXXXXXXXXXXXXXXXXXXXXXXXXX

XXXXXXXXXXXXXXXXXXXXXXXXXXXXXXXXXXXX
 T   T   T   T   T   T   T   T   T
```

X = Knit
T = Tuck
□ = Miss

FIG. 3

BASE LAYER APPAREL

FIELD OF THE INVENTION

The present invention relates generally to textile products, and more particularly, to a flame resistant, base layer apparel and fabric therefore.

BACKGROUND OF THE INVENTION

"Base layer" apparel conventionally refers to garments that are worn against the skin, often as inner garments such as underwear, T-shirts, and brassieres, beneath outerwear such as trousers, shirts/blouses, skirts, etc. Such garments are formed to have a soft touch, or hand, and among other things, provide support against the skin, and serve to absorb perspiration during normal daily activities. Most of these garments are made substantially of cotton, a natural fiber that is inexpensive and quite suitable for most wearers and most applications.

Unfortunately, however, base layer garments formed of conventional yarns and fabrics are not adequate for wear in occupations defined by potential hazardous exposures to sources of ignition, or high voltage electricity. While cotton base layer apparel may be treated to afford some flame-resistance, the chemical treatment on the cotton fibers degrades over the life of the garment through physical wear and laundering. This, of course, is unsatisfactory for base layer apparel for military personnel that is subjected to extreme wear conditions. Coupled with the constant risk in combat areas of bodily harm from the ignition of highly flammable materials such as gas and explosives, incendiary, or flame-producing munitions, something more is needed to personal protection.

While some flame-resistant yarns and fibers are now known for use in manufacturing apparel, these materials alone do not provide a satisfactory degree of comfort when formed into base layer apparel worn adjacent the skin. Most of these synthetic flame resistant materials also are generally hydrophobic, meaning that they lack an affinity to and absorbency for moisture and/or body perspiration.

What is needed is a fabric for base layer apparel that provides not only adequate, long-term, flame resistance, but that also is moisture absorbent and has a soft hand that is comfortable to the wearer under conditions such as high temperature and high humidity, and for extended periods.

SUMMARY OF THE INVENTION

A primary aspect of the present invention is a base layer apparel made up of at least about sixty percent modacylic fibers and up to about forty percent flame resistant viscose fibers. As used herein, "base layer" refers to fabric or apparel constructions for wear as a first layer directly against the skin of the wearer; e.g., underwear, T-shirts, and thermal undergarments.

The fabric for the base layer apparel may be formed in various constructions. It may be jersey knit in a single layer or may be a double-knit construction having first and second sides formed on a circular knitting machine of the type having needles in the cylinder and dial. The yarns are ring-spun fire resistant yarns comprising an intimate blend of at least about sixty percent modacrylic fibers and up to about forty percent fire-resistant viscose fibers. Preferably, the modacrylic fibers comprise between about seventy-four percent and eighty percent of the intimate blend and the fire resistant viscose fibers comprise between about twenty percent and twenty-six percent of the intimate blend. Yarn sizes found most suitable for the knit fabric construction are between about 30/1 cc and 36/1 cc, however other sizes may also be satisfactory.

One of the two sides of the double-knit fabric version is knitted as an open mesh, or foramenous, structure. This open mesh side is defined by openings between the yarns that are larger than the openings between the yarns on the opposite side of the fabric. As will be more apparent from the detailed description that follows, this double-knit construction is helpful to induce moisture migration (wicking) outwardly away from the wearer's skin.

Chemical treatments may be applied to the fabric during dyeing and fabric finishing. One chemical is a wicking agent that may be applied during the jet dyeing process to facilitate movement of moisture throughout the fabric during wear. For certain types of base layer apparel, such as underwear and T-shirts, an anti-microbial treatment also may be applied during or after the dyeing process of the greige fabric to inhibit or prevent the growth of micro-organisms.

The embodiments described above are exemplary only, and other aspects of the present invention will become apparent to those skilled in the art after a reading of the following description of the preferred embodiment in combination with the figures.

BRIEF DESCRIPTION OF THE DRAWINGS

FIG. 3 is the knitting diagram for the double-knit fabric illustrated in FIGS. 1 and 2.

DESCRIPTION OF THE PREFERRED EMBODIMENT

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

DEFINITIONS

"Anti-Microbial" describes the property of a material or substance that tends to destroy microbes, prevent their development, or inhibit their pathogenic action.

"Base layer" refers to fabric or apparel constructions for wear as a first layer directly against the skin of the wearer "Double-Knit" describes a fabric formed on a circular knitting machine equipped with two sets of latch needles situated at right angles to each other (dial and cylinder)

"Flame resistant," as used herein, describes a material that burns slowly or is self-extinguishing after removal of an external source of ignition. A fabric or yarn can be flame resistant because of the inherent properties of the material, the twist level of the yarn, the fabric construction, the presence of flame retardants, or a combination thereof.

"Intimate blend" refers to a technique of mixing two or more dissimilar fibers in a very uniform mixture.

"Mesh," or "Open Mesh," as used herein, describes a fabric construction characterized by open spaces between the yarns in one or more layers, plies, or sides of the fabric.

Figure 4:
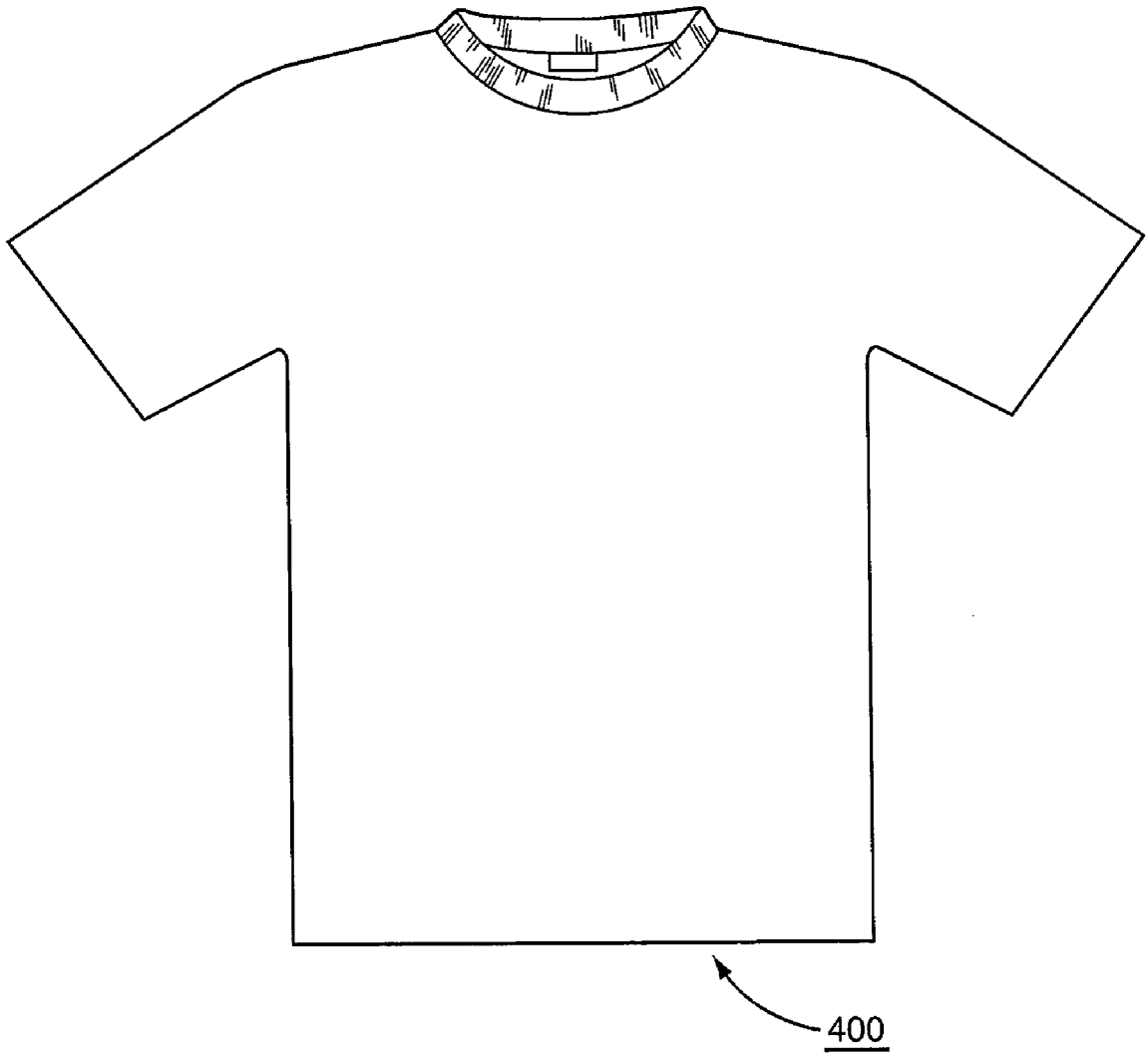
FIG. 4 is representative of one type of apparel formed from the double-knit fabric of the present invention.

"Wicking" refers to the action of the dispersing or spreading of moisture or liquid over a given area One aspect of the present invention is directed to a base layer apparel, such as underwear and T-shirts (FIG. 4) that addresses the problems described above. More particularly, the base layer apparel of the present invention is formed from a fabric comprising yarns that are an intimate blend of flame resistant fibers, as described in greater detail below.

In one preferred embodiment, the fabric is a double-knit construction having first and second surfaces or sides formed on a circular knitting machine. Each of the surfaces includes ring-spun fire resistant yarns. In this embodiment, the yarns are formed from an intimate blend of modacrylic staple fibers and flame resistant (FR) viscose staple fibers.

Modacrylics are polymers that have between thirty-five percent and eighty-five percent acrylonitrile units, modified by other chemical modifiers such as vinyl chloride. All modacrylics have an inherently flame-resistant character to some extent; however, it has been found that fabrics formed from modacrylic yarns having at least about fifty percent by weight of acrylonitrile units will provide excellent flame resistance. That is, they will not melt and drip, or continue to burn when a source of ignition is removed. One suitable modacrylic is a short staple fiber such as Kanecaron® Protex, manufactured by Kaneka Corporation, Osaka, Japan. These fibers have a tenacity of greater than about two grams/denier, and preferably about three grams/denier. In one embodiment, the staples are two inches in length and have a denier of about 1.5, however other fiber deniers are also within the scope of the invention. In addition to their good flame resistance, modacrylic fibers high a high degree of washability, meaning that soils or stains are more easily removed during laundering. Modacrylic fibers, and yarns formed exclusively therefore, do have some inherent drawbacks. In particular, modacrylic yarns do not hold knitted stitches well. As a result, fabrics formed from these yarns alone often lack dimensional stability. When subjected to wear and laundering, the courses and wales of the fabric tend to stretch, or "grow."

Viscose fibers, sometimes known as "rayon," are derived from wood pulp. Flame resistant viscose fibers are viscose fibers that are chemically treated to impart heat and flame resistance to the fibers. As such, these treated fibers are adapted for applications in which protection is sought from fire, radiant heat, electrical arcs, etc. One suitable flame resistant viscose fiber is LENZING®, available from Lenzing Fibers with facilities in Mobile, Ala. While rayon generally has poor washability in comparison to modacrylic, it is relatively moisture absorbent and has been found to stabilize the fabric structure and contribute to the softness of the fabric. Because of its poor washability, the inventors have found that these fire resistant fibers should not comprise more than about forty percent of the intimate blend.

In general, the inventors have found that an intimate blend of modacrylic and fire resistant viscose fibers may be used to form a lighter weight fabric construction. The flame resistant yarns are ring-spun from an intimate blend of at least about sixty percent modacrylic fibers and up to about forty percent fire-resistant viscose fibers. Preferably, the modacrylic fibers comprise between about seventy-four percent and eighty percent of the intimate blend and the fire resistant viscose fibers comprise between about twenty percent and twenty-six percent of the intimate blend, even more preferably a blend of 77/23 modacrylic/FR viscose. While a blend of only modacrylic and FR viscose is preferred, minor amounts of other fibers such as natural fibers like cotton or wool, or polymeric fibers like polyester and the like could be added. In the embodiment described herein, the inventors have learned that a yarn size of between about 30/1 cc and 36/1 cc is quite suitable for forming the fabric and apparel claimed herein, however other yarn sizes are conceivable.

Turning now to the figures in general, the double-knit fabric for the base layer apparel formed according to the present invention is shown. While the embodiment described herein is a double-knit construction, the fabric construction is not limited thereto. Those skilled in the art will appreciate that a single, or multi-ply, fabric satisfy the objectives of the inventors. For example, single ply jersey knit is also within the scope envisioned. Other knits, and even woven fabrics are contemplated.

Figure 1:
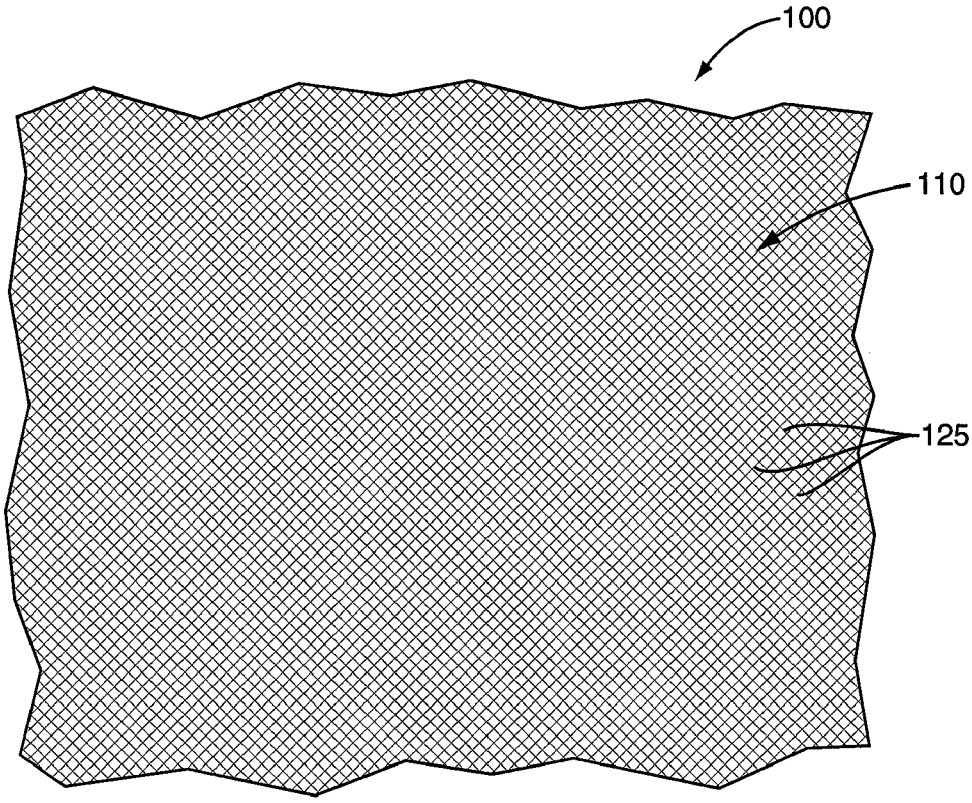
FIG. 1 is a schematic representation of one surface of the double-knit fabric version of the present invention.
Figure 2:
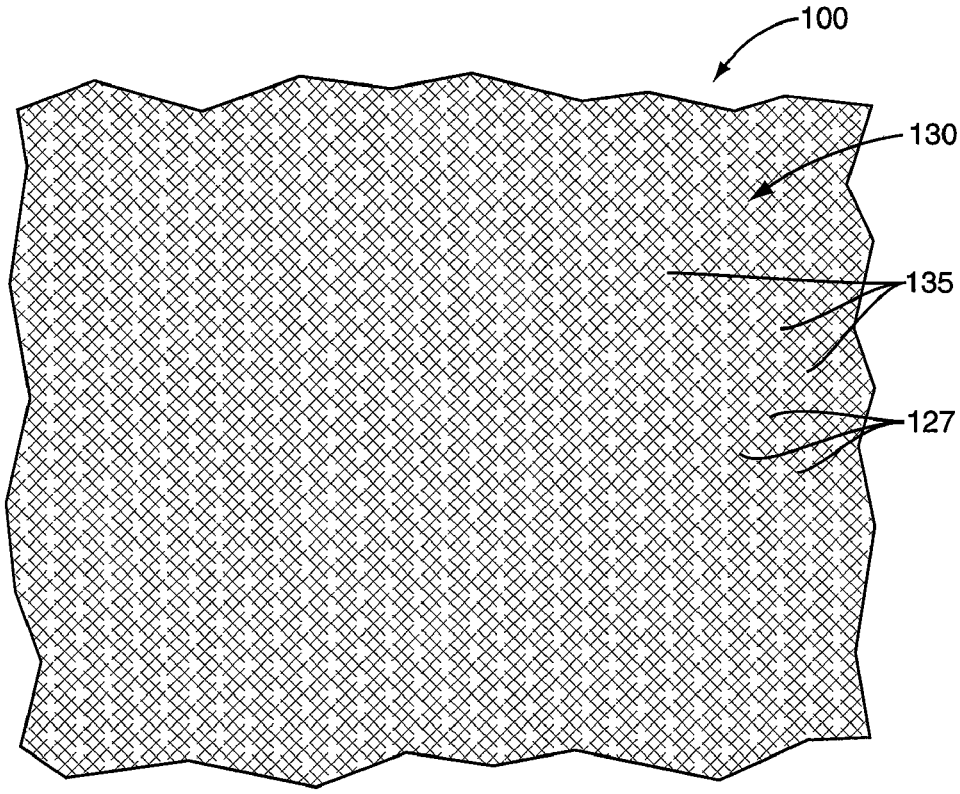
FIG. 2 is a schematic representation of the opposite, open mesh surface of the double-knit fabric version of the present invention.

As shown in FIGS. 1 and 2, a representative fabric 100 for the base layer apparel comprises two surfaces or sides 110, 130. The machine used to form the double-knit fabric is a Model 15 Mon 1680 NDL-84F-MEM circular knitting machine available from Monarch Knitting of England. Circular knitting machines of this type comprise a 30 inch knitting cylinder, with 80 feeds, and is configured for 18-cut. Eighteen cut refers to the number (18) of needles per inch and fabric so formed is known as 18-cut fabric. The dial setting for this embodiment is "A-M-A-M-A-M-A-M," where A represents a knit stitch and M represents a miss-stitch, also known in the art as a float-stitch. The dial side setting forms the mesh side of the double-knit fabric. The cylinder setup is best shown in the diagram of FIG. 3, where each space represents a possible needle position/action, or a miss, for the fabric pattern and the two sides thereof. One exemplary machine setup comprises a 243 inch revolution, set for 14.5 inches per one hundred needles, or 0.145 inches per needle.

Referring again to FIGS. 1 and 2, a representation of the two sides of the double-knit fabric are shown. As shown in FIG. 1, the inner side (preferably the side facing inwardly and against the skin of the wearer of the apparel) has a tighter knit construction with the courses and wales of the yarns 125 being more dense relative to the outer open mesh side 130, shown in FIG. 2. In FIG. 1, the inner side has openings between the yarns 125 that are barely visible to the naked eye, whereas the openings 135 between the yarns 125 on the open mesh side are substantially larger and more readily visible.

As the inventors have found, when one side of the fabric is knitted as an open mesh, having larger openings between yarns, and when the yarns of the two sides of the fabric are in contact, wicking of moisture is promoted. That is, having the two sides with different yarns densities creates an affinity for moisture to move from a wetted side to a dryer side. Thus, for example, when the side with the greater stitch (course) density is worn against the skin, moisture/perspiration will be drawn to the outer mesh side with the more open structure. This open structure also provides for enhanced air movement and ventilation, which serves to more easily evaporate the moisture driven to the outer mesh surface. Alternatively, the mesh side of the fabric may be worn as the inner layer against the skin and the side with the greater stitch density may be worn as the outer layer. One example of a type of base layer apparel incorporating the double-knit fabric described herein is a T-shirt 400, shown generally in FIG. 4.

Exemplary fabrics formed as described herein were subjected to numerous tests including: (1) Flame Resistance (Vertical Flame) (ASTM D 6413); (2) Thermal Stability and Thermal Protective Performance (NFPA 1971); (3) Pilling Resistance (Rando Tumble) (ASTM D 3512); (4) Dimensional Change After Home Laundering (5 Cycles) (AATCC 135); (5) Water Vapor Transmission Rate (ASTM E 96); (6) Antibacterial Finish Assessment (AATCC 100); and, (7) Static Decay and Moisture Wicking (FTMS 191A, Method 4504).

To further promote wicking of moisture outwardly away from the wearer of an article of apparel formed of the fabric described herein, a wicking agent may be applied to the greige, or unfinished, fabric during the dyeing process. While the particular dyeing process is not important to the present invention, jet dyeing is one suitable process for both dyeing and applying wet chemicals to a fabric. More particularly, one wicking agent found to be particularly effective at wicking moisture is ANWICK LW™, a proprietary product available from R.T. Anderson Enterprises of Raleigh, N.C. When ANWICK LW™ is applied to a fabric, the resulting fabric has a hydrophilic characteristic which allows for moisture transport away from the body, permitting evaporation while retaining the strength of the fibers comprising the fabric. Other wicking agents compatible with the yarns and apparel uses are also contemplated.

For base layer apparel that is worn under conditions likely to promote microbial/bacterial growth, such as high humidity, an anti-microbial treatment may be applied either during the dyeing process or by subsequent padding of the wet dyed fabric. One effective anti-microbial treatment is known as ATS ULTRA FRESH™ MVN-2, a 2,4,4' tricholor-2' hydroxydiphenyl ether, available from American Textile Specialties of Spartanburg, S.C. Other anti-microbial agents may also be used that are compatible with the fibers and safe to use in apparel worn next to the skin.

While the embodiment described herein above is described in detail, it is apparent that other combinations of the modacrylic and flame resistant viscose fibers could be used. For example, it is believed any blend of at least about sixty percent modacrylic and up to about forty percent flame resistant rayon will produce a satisfactory fabric for use in the base layer apparel, regardless of the knitting procedure. Also, as stated herein above, so long as modacrylic and FR viscose are the primary constituents, smaller amounts of other fibers may be added. In the same vein, other yarn sizes, fiber denier, and knit or weave construction are possible.

Certain other modifications and improvements may occur to those skilled in the art upon a reading of the foregoing description. It should be understood that all such modifications and improvements have been deleted herein for the sake of conciseness and readability but are properly within the scope of the following claims.

We claim:

1. A garment, comprising:

(a) an article of base layer apparel for wear adjacent the skin and selected from the group consisting of long underwear, short underwear, and undershirts, and formed of a knit fabric, comprising:

(i) ring spun flame-resistant yarns comprising an intimate blend of between 74 percent and 80 percent modacrylic fibers and between 20 percent and 26 percent flame-resistant viscose fibers, wherein the modacrylic constituent has at least 50 percent acrylonitrile units, and further wherein the yarn size is between 30/1 cc and 36/1 cc, and the modacrylic fibers have a denier of about 1.5;

(ii) wherein the yarns are formed into a double knit construction having a first skin-contact layer and a second layer, the first skin-contact layer having first open spaces and a second outer layer having second open spaces larger than the first open spaces;

(b) wherein the article of base layer apparel is flame resistant, moisture absorbent, and has a soft hand suitable for wear in direct contact with a wearer's skin for extended periods in high temperature and high humidity environments.

2. The base layer apparel of claim 1 wherein the modacrylic fibers are about 2 inches in length and the yarn size is 30/1 cc.

3. An undergarment, comprising:

(a) an article of base layer apparel for wear adjacent the skin and selected from the group consisting of long underwear, short underwear, and undershirts, and formed of a jersey knit fabric, comprising:

(i) ring spun flame-resistant yarns comprising an intimate blend of at between 74 percent and 80 percent modacrylic fibers and between 20 percent and 26 percent flame-resistant viscose fibers, wherein the modacrylic constituent has at least 50 percent acrylonitrile units, and further wherein the yarn size is between 30/1 cc and 36/1 cc, and the modacrylic fibers have a denier of about 1.5; and (b) wherein the article of base layer apparel is flame resistant, moisture absorbent, and has a soft hand suitable for wear in direct contact with a wearer's skin for extended periods in high temperature and high humidity environments.

4. A T-shirt, comprising:

(a) a knit fabric forming a tubular body portion open at the bottom and having a pair of arm openings and a neck opening, the knit fabric comprising:

(i) ring spun fire-resistant yarns comprising an intimate blend of at between 74 percent and 80 percent modacrylic fibers and between 20 percent and 26 percent fire-resistant viscose fibers, wherein the modacrylic constituent has at least 50 percent acrylonitrile units, and further wherein the yarn size is between 30/1 cc and 36/1 cc, and the modacrylic fibers have a denier of about 1.5; and (b) wherein the T-shirt is flame resistant, moisture absorbent, and has a soft hand suitable for wear in direct contact with a wearer's skin for extended periods in high temperature and high humidity environments.

5. The T-shirt of claim 4 wherein the yarns are formed into a double knit construction having one of the layers comprising an open mesh construction having open spaces larger than the other of the double knit layers.

6. The garment of claim 1, wherein the knit fabric comprises at least one of a wicking treatment and an anti-microbial treatment applied to the fabric.

7. The undergarment of claim 3, wherein the knit fabric comprises at least one of a wicking treatment and an anti-microbial treatment applied to the fabric.

8. The undergarment of claim 3, wherein the modacrylic fibers are about 2 inches in length and the yarn size is 30/1 cc.

9. The T-shirt of claim 4, wherein the knit fabric comprises at least one of a wicking treatment and an anti-microbial treatment applied to the fabric.

* * * * *